US009492704B2

(12) United States Patent
Mortensen et al.

(10) Patent No.: US 9,492,704 B2
(45) Date of Patent: Nov. 15, 2016

(54) FOLDING REAR DRIVE ELLIPTICAL

(71) Applicant: ICON Health & Fitness, Inc., Logan, UT (US)

(72) Inventors: Nathan Mortensen, Montpelier, ID (US); William T. Dalebout, North Logan, UT (US); Trenton Von Larsen, Hyrum, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 19 days.

(21) Appl. No.: 14/303,464

(22) Filed: Jun. 12, 2014

(65) Prior Publication Data

US 2014/0371035 A1 Dec. 18, 2014

Related U.S. Application Data

(60) Provisional application No. 61/834,706, filed on Jun. 13, 2013.

(51) Int. Cl.
*A63B 22/04* (2006.01)
*A63B 22/00* (2006.01)
(Continued)

(52) U.S. Cl.
CPC ..... *A63B 22/0002* (2013.01); *A63B 22/0012* (2013.01); *A63B 22/0664* (2013.01);
(Continued)

(58) Field of Classification Search
CPC ..... A63B 22/0002; A63B 22/0664; A63B 22/0012; A63B 2225/09; A63B 2225/093; A63B 2071/025; A63B 2071/0625; A63B 2071/063; A63B 71/0619
See application file for complete search history.

(56) References Cited

U.S. PATENT DOCUMENTS 5,746,683 A * 5/1998 Lee ..... A63B 22/001 482/51
5,755,643 A * 5/1998 Sands ..... A63B 22/001 482/51

(Continued)

FOREIGN PATENT DOCUMENTS

CN 201815049 U 5/2011
WO 9958204 A1 11/1999
WO 2008138124 11/2008

OTHER PUBLICATIONS

Icon Health & Fitness, U.S. Appl. No. 14/303,451, filed Jun. 12, 2014.

(Continued)

*Primary Examiner* — Loan H Thanh
*Assistant Examiner* — Megan Anderson
(74) *Attorney, Agent, or Firm* — Holland & Hart LLP

(57) ABSTRACT

Embodiments of an elliptical exercise machine are provided including an elliptical exercise machine having a rear mechanism that is foldable or collapsible from an operating position to a storage position. In one embodiment, the elliptical machine includes a first assembly pivotally coupled with a second assembly. The first assembly includes a first frame member, a rear rotational mechanism and first and second foot supports operably coupled with the rotational mechanism. The second assembly includes a second frame member, a first reciprocating arm and a second reciprocating arm. The second assembly may be displaced relative to the first assembly from an operating position to a storage position without having to alter the operational relationships of the components of the first assembly and without having to alter the operational relationships of the components of the second assembly.

18 Claims, 6 Drawing Sheets

(51) Int. Cl.
*A63B 71/06* (2006.01)
*A63B 22/06* (2006.01)

(52) U.S. Cl.
CPC ..... *A63B71/0619* (2013.01); *A63B 2022/067* (2013.01); *A63B 2071/063* (2013.01); *A63B 2071/0625* (2013.01); *A63B 2210/50* (2013.01); *A63B 2225/093* (2013.01)

(56) References Cited

U.S. PATENT DOCUMENTS 5,782,722 A * 7/1998 Sands ..... A63B 22/001 482/51
5,860,895 A * 1/1999 Lee ..... A63B 22/001 482/51
6,030,320 A * 2/2000 Stearns ..... A63B 22/0664 482/51
6,149,551 A * 11/2000 Pyles ..... A63B 22/0664 482/51
6,190,289 B1 2/2001 Pyles et al.
7,462,135 B2 * 12/2008 Lo ..... A63B 22/001 482/52
7,775,940 B2 8/2010 Dalebout et al.
8,663,070 B2 * 3/2014 Long ..... A63B 22/001 482/51
2008/0280733 A1 * 11/2008 Dickie ..... A63B 22/001 482/52
2010/0167880 A1 7/2010 Long et al.
2010/0242246 A1 * 9/2010 Dalebout ..... A63B 22/001 29/401.1
2012/0088638 A1 4/2012 Lull

OTHER PUBLICATIONS

Icon Health & Fitness, U.S. Appl. No. 14/303,459, filed Jun. 12, 2014.
International Search Report issued for PCT/US2014/042179 on Oct. 10, 2014.
English Machine Translation of claim 1 of CN 201815049 published on May 4, 2011.

* cited by examiner

FOLDING REAR DRIVE ELLIPTICAL

CROSS-REFERENCE TO RELATED APPLICATIONS

This application claims priority to U.S. Provisional Patent Application No. 61/834,706 filed on Jun. 13, 2013 and is related to U.S. Provisional Patent Application No. 61/834,709 filed on Jun. 13, 2013 and U.S. Provisional Patent Application No. 61/834,711 filed on Jun. 13, 2013.

TECHNICAL FIELD

The present disclosure relates to exercise equipment. More particularly, the present disclosure relates to elliptical type exercise devices that include a folding mechanism.

BACKGROUND

There are many types of exercise machines available for individuals to utilize in maintaining physical fitness. Many people have obtained exercise machines for their home so that they can exercise at their convenience without having to travel to a gym or other remote location. Home exercise equipment may include, for example, free weights, weight stacks, resistance weights, treadmills, stationary bicycles and elliptical machines.

While each type of equipment provides certain benefits, elliptical machines are popular with many individuals because they are considered to be a non-impact exercise which is easy on the joints of an individual. Generally speaking, conventional elliptical machines include alternating reciprocating foot supports configured to traverse or travel about a closed path to simulate a striding, running, walking, and/or a climbing motion for the individual using the machine. Each reciprocating foot support conventionally has one end supported for rotational motion about a pivot point, with the other end supported in a manner configured to cause the reciprocating foot support to travel or traverse a closed path, such as a reciprocating elliptical or oblong path or other similar geometric outline. During operation of the elliptical machine, each reciprocating foot support is caused to travel or traverse the closed path, thereby simulating a striding motion of the user for exercise purposes. The reciprocating foot supports are conventionally configured to be out of phase with one another by 180° in order to simulate a proper and natural alternating stride motion.

An individual may utilize an elliptical exercise machine by placing his or her feet onto the reciprocating foot supports and actuating the exercise machine to cause the reciprocating foot supports to repeatedly travel their respective closed paths. This action effectively results in a series of strides achieved by the individual to obtain exercise, with a low-impact advantage. An elliptical exercise machine may further comprise mechanisms or systems for increasing the resistance of the motion. In addition, the reciprocating motion of the feet to achieve a series of strides may be complemented by a reciprocating movement of the arms, whether assisted by the exercise machine via a suitably configured mechanism or system, or unassisted.

Elliptical machines may be configured as a "front mechanism" or a "rear mechanism" type machine. Such a designation indicates where the rotating mechanism (typically a flywheel) attached to the foot supports is located—i.e., at the front of the machine or at the rear of the machine. The location of the rotating mechanism typically has an impact on the path of the foot supports. For example, a front mechanism is often considered to produce a longer, flatter stride, while a rear mechanism is considered to produce a more circular path that includes more elevation change within the path. To a certain degree, the issue of choosing an elliptical machine with either a rear mechanism or a front mechanism is a matter of choice by the user.

One of the inherent characteristics of an elliptical machine is the inherently large size of such equipment. In other words, elliptical exercise machines typically occupy a substantial amount of space within a room and require even more space for proper operation. While space is not a major issue in most commercial settings, such as athletic fitness or sports centers, spas, resorts, etc., the same is not true when the exercise machine is intended for residential use. It is noted that, when in a residential setting, elliptical machines are typically not in use for the majority of the day and, thus, simply consume space for the majority of their existence.

There have been a variety of attempts to provide an elliptical exercise machine that is also "space saving" in some aspect or another. However, such attempts have often resulted in some type of compromise in the overall design of the machine or have not provided the performance or the convenience expected by an end user.

Examples of elliptical machines that have been configured to fold, in an attempt to save space during non-use of the elliptical machine include those described by U.S. Pat. No. 7,775,940 to Dalebout et al., U.S. Pat. No. 6,190,289 to Pyles et al. and PCT Patent Application Publication No. WO2008138124 to Spark Innovations, Inc. The Pyles patent describes an elliptical machine having a front mechanism, wherein foot supports and related components are pivotable upwards toward the control panel/display to be placed in a storage position or state. The Dalebout patent appears to describe an elliptical machine having a rear mechanism, wherein various components are decoupled or disconnected in order to "fold" the elliptical machine into a storage position (and reconnected in order to be placed back into a useable state). The Spark Innovations publication appears to describe an elliptical machine with a rear mechanism wherein the reciprocating arms require adjustment to their positions in order to be transitioned between a useable state and the stored state.

In view of the foregoing, it would be desirable to provide an elliptical exercise machine that maintains all of the beneficial operational functions of prior related elliptical exercise machines while in operation, but that also is capable of substantially reducing the space being occupied by the elliptical exercise machine in a given room when it is not in use.

SUMMARY

In one aspect of the disclosure, an elliptical exercise machine is provided. The elliptical exercise machine includes a first assembly and a second assembly. The first assembly includes a first frame member, a rear rotational mechanism associated with the first frame member, a first foot support member pivotally coupled to a portion of the rotational mechanism and a second foot support member pivotally coupled to another portion of the rotational mechanism. The second assembly includes a second frame member, a first reciprocating arm pivotally coupled with the second frame member and a second reciprocating arm pivotally coupled with the second frame member. The second assembly is pivotally displaceable between a first position and a second position relative to the first assembly, wherein the first frame member, the rotational mechanism, the first foot support member and the second foot support member maintain their operational relationships with each other while in both the first position and the second position, and wherein the second frame member, the first reciprocating arm and the second reciprocating arm maintain their operational relationships with each other while in both the first position and the second position.

In another aspect, which may be combined with one or more other aspects, the elliptical exercise machine may further comprise a pivot structure coupled between the first frame member and the second frame member.

In another aspect, which may be combined with one or more other aspects, the first foot support may be pivotally coupled the first reciprocating arm and the second foot support may be pivotally coupled with the second reciprocating arm.

In another aspect, which may be combined with one or more other aspects, the axis of the pivotal coupling between the first foot support and the first reciprocating arm, the axis of the pivotal coupling of the second foot support and the second reciprocating arm and the axis of the pivotal structure may be substantially aligned when the second assembly is in the storage position.

In another aspect, which may be combined with one or more other aspects, the pivotal coupling between the first foot support and the first reciprocating arm and the pivotal coupling second foot support and the second reciprocating arm may remain in place during displacement of the second assembly between the first and second positions.

In another aspect, which may be combined with one or more other aspects, the elliptical machine further includes a locking mechanism configured to selectively maintain the second assembly in the first position relative to the first assembly.

In another aspect, which may be combined with one or more other aspects, the locking mechanism may include a fastener coupled with a hand-rotatable handle, the fastener being associated with the second assembly, wherein the fastener is configured to selectively engage a component associated with the first assembly.

In another aspect, which may be combined with one or more other aspects, the elliptical machine may further comprising a first foot pad coupled with the first foot support and a second foot pad coupled with the second foot support.

In another aspect, which may be combined with one or more other aspects, the elliptical machine may comprise a first cross member coupled with the first frame member, a second cross member coupled with the first frame member, a handle coupled with the first cross member and at least one wheel coupled with the second cross member.

In another aspect of the disclosure, an elliptical machine is provided that includes a first assembly and a second assembly. The first assembly includes a first frame member, a rear rotational mechanism associated with the first frame member, a first foot support member pivotally coupled to a portion of the rotational mechanism and a second foot support member pivotally coupled to another portion of the rotational mechanism. The second assembly includes a second frame member pivotally coupled with the first frame member, a first reciprocating arm pivotally coupled with the second frame member at a first location and pivotally coupled to the first foot support at a second location and a second reciprocating arm pivotally coupled with the second frame member at a first location and pivotally coupled with the second foot support at a second location. The second assembly is pivotally displaceable relative to the first assembly between a operating position and a storage position, wherein the first reciprocating arm and the second reciprocating arm are not adjusted relative to the second frame member in order to place the second assembly in the storage position and wherein the first foot support and the second foot support are not disconnected from the rotational mechanism in order to place the second assembly in the storage position.

In another aspect, which may be combined with one or more other aspects, the pivotal coupling between the first foot support and the first reciprocating arm and the pivotal coupling second foot support and the second reciprocating arm may remain in place during displacement of the second assembly between the operating and storage positions.

In another aspect, which may be combined with one or more other aspects, the elliptical machine may comprise a locking mechanism configured to selectively maintain the second assembly in the operating position.

In another aspect, which may be combined with one or more other aspects, the locking mechanism may include a fastener coupled with a hand-rotatable handle, the fastener being associated with the second assembly, wherein the fastener is configured to selectively engage a component associated with the first assembly.

In another aspect, which may be combined with one or more other aspects, the elliptical machine may includes a first foot pad coupled with the first foot support and a second foot pad coupled with the second foot support.

In another aspect, which may be combined with one or more other aspects, the elliptical exercise machine may comprise a first cross member coupled with the first frame member, a second cross member coupled with the first frame member, a handle coupled with the first cross member and at least one wheel coupled with the second cross member.

In another aspect, which may be combined with one or more other aspects, the axis of the pivotal coupling between the first foot support and the first reciprocating arm, the axis of the pivotal coupled of the second foot support and the second reciprocating arm and the axis of the pivotal coupling of the first frame member and the second frame member are substantially aligned when the second assembly is in the storage position.

In another aspect of the disclosure, a method of storing an elliptical exercise machine is provided. The method includes: providing a first assembly having a frame member, a rear rotational mechanism, a first foot support and a second foot support; providing a second assembly having a second frame member, a first reciprocating arm and a second reciprocating arm; and displacing the first assembly from an operating position to a stored position while maintaining the operational relationships of the first frame member, rotational mechanism, the first foot support and the second foot support and while maintaining the operational relationships of the first reciprocating arm, the second reciprocating arm and the second frame member.

In another aspect, which may be combined with one or more other aspects, the method may include providing a pivot structure coupled with the first assembly and the second assembly, and wherein displacing the first assembly from an operating position to a stored position includes pivoting the first assembly about the pivot structure.

In another aspect, which may be combined with one or more other aspects, the method may include pivotally coupling the first foot support with the first reciprocating arm, pivotally coupling the second foot support with the second reciprocating arm and maintaining the pivotal coupling between the first foot support with the first reciprocating arm and maintaining the pivotal coupling between the second foot support with the second reciprocating arm while displacing the first assembly from the operating position to the stored position.

In another aspect, which may be combined with one or more other aspects, the method further includes disengaging a locking mechanism prior to displacing the first assembly from the operating position to the stored position.

BRIEF DESCRIPTION OF THE DRAWINGS

The accompanying drawings illustrate various embodiments of the present methods and systems and are a part of the specification. The illustrated embodiments are merely examples of the present systems and methods and do not limit the scope thereof.

Throughout the drawings, identical reference numbers designate similar, but not necessarily identical, elements.

DETAILED DESCRIPTION

Figure 1:
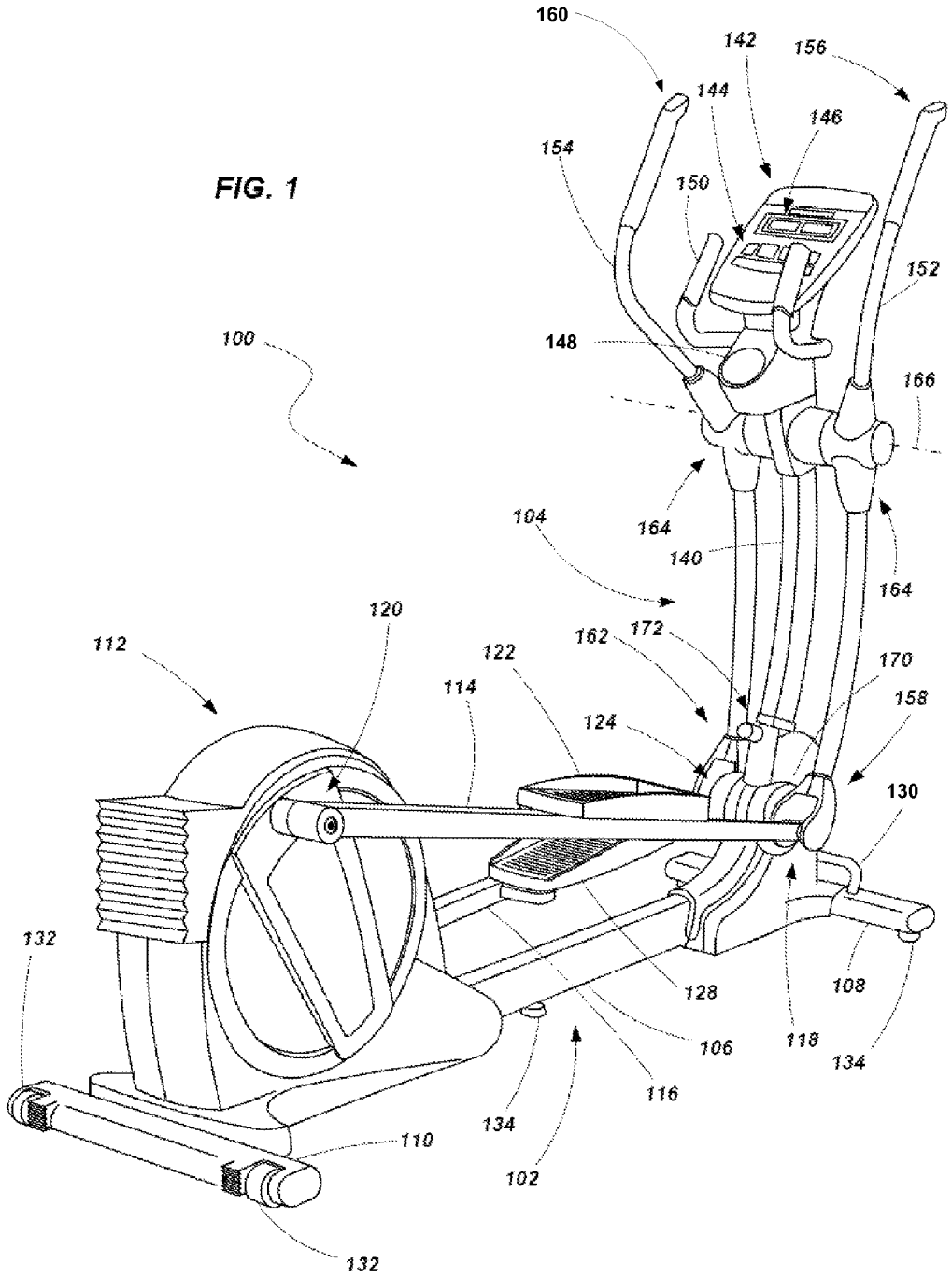
FIG. 1 is a perspective view of an elliptical exercise machine.
Figure 2:
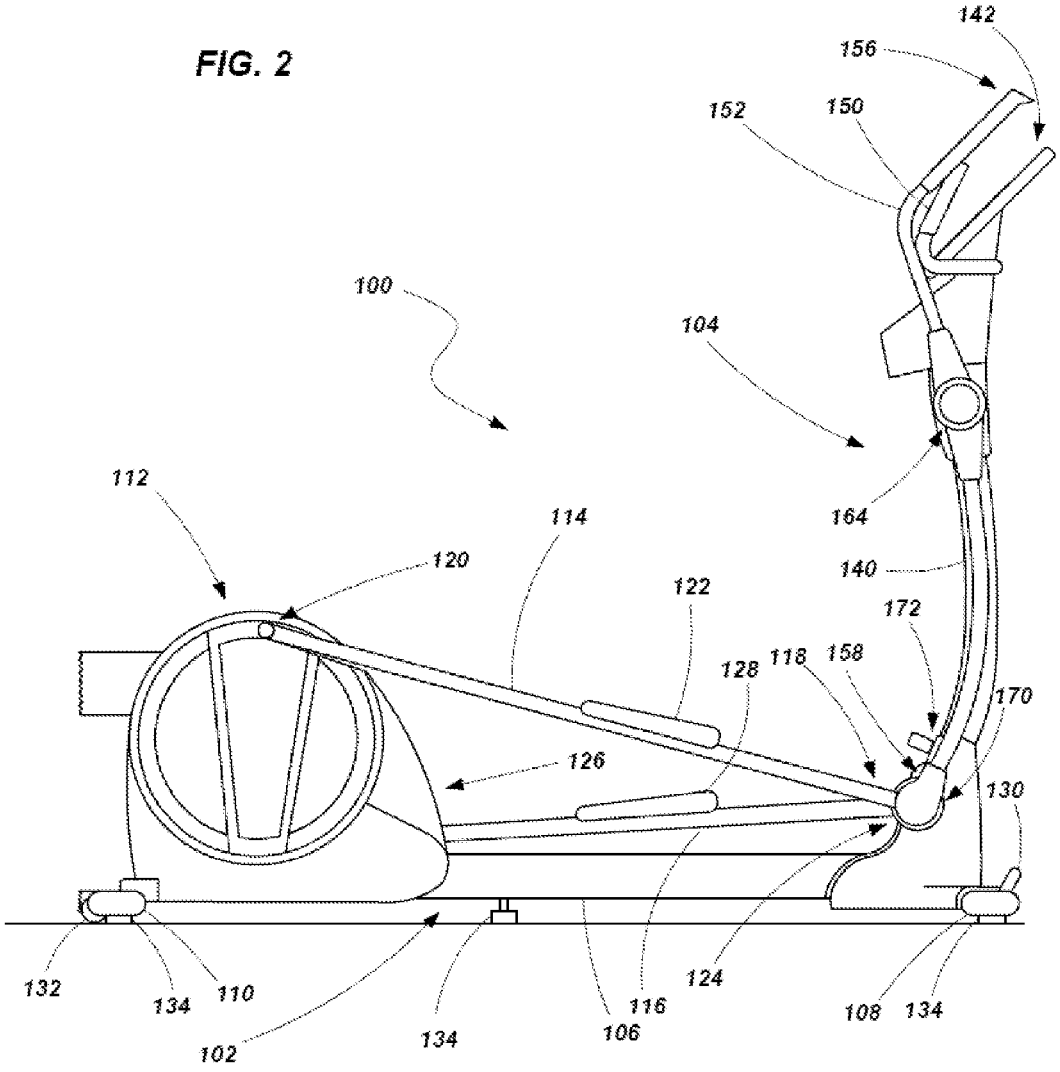
FIG. 2 is a first side view of the elliptical machine shown in FIG. 1.

Referring to FIGS. 1 and 2, an elliptical exercise machine 100 is shown and described. The elliptical exercise machine 100 includes a first assembly 102 operatively coupled with a second assembly 104. The first assembly 102 includes a longitudinal frame member 106 coupled with a first foot or cross member 108 and a second foot or cross member 110. A rear drive/resistance mechanism 112 (referred to herein as the rear mechanism 112 for convenience) is coupled with the frame member 106 and may include, for example, a flywheel and a resistance mechanism as will be appreciated by those of ordinary skill in the art. The resistance mechanism may include a magnetic braking mechanism, sometimes referred to as an eddy current brake, to provide a desired level of resistance to the user during operation of the exercise machine 100. While described in connection with an exercise bicycle, one example of a flywheel, as well as an associated magnetic braking mechanism, is described by U.S. Patent Application Publication No. 2012/0088638 to Lull (application Ser. No. 13/267,719), the disclosure of which is incorporated by reference herein in its entirety.

The lower assembly 102 further includes a first reciprocating foot support 114 and a second reciprocating foot support 116. The first foot support 114 has a first end 118 and a second end 120, the second end 120 being pivotally coupled with the rear mechanism 112 such that the second end 120 of the foot support 114 travels in a substantially circular path during operation of the elliptical machine 100. A foot pad 122 is disposed on the first foot support at a location between the first end 118 and the second end 120. The foot pad 122 is sized and configured to receive and support a foot of a user and may either be integrally formed with the foot support 114 or formed as a separate component and coupled with the foot support 114 (e.g., by fasteners, adhesive, or other mechanical or material techniques). The second reciprocating foot support 116 likewise includes a first end 124 and a second end 126, with the second end 126 being pivotally coupled with the rear mechanism 112 such that the second end 126 of the foot support 116 travels in a substantially circular path during operation of the elliptical machine 100. A second foot pad 128 is disposed on the second foot support 116 at a location between the first end 124 and the second end 126.

The first and second reciprocating foot supports 114 and 116 are laterally spaced apart from one another such that each of the corresponding foot pads 122 and 128 receive the right and left feet, respectively, of a user for facilitating a striding motion with the user during use of the machine 100. The foot pads 122 and 128 may be configured with surface features (e.g., ribs, grooves, knobs, etc) to provide traction to the foot of a user. In other embodiments, while the foot pads may not necessarily include surface features, they may include a non-slip material to provide traction to the foot of a user. The foot pads 122 and 128 may be adjustable relative to their associated foot supports 114 and 116 such that they may be positioned at different locations along the lengths of the foot supports 114 and 116 to accommodate the preferences of different users.

The first assembly 102 may include a number of additional components or features. For example, a handle 130 may be coupled with front cross member 108 to assist in lifting or moving the elliptical machine 100. Additional handles may be coupled to other portions of the elliptical machine 100 to further enable a user to more easily lift or move the elliptical machine 100. One or more wheels 132 may be coupled to the rear cross member 110 to enable a user to more easily move the elliptical machine 100 from one location to another by, for example, lifting on the front handle 130 and rolling the elliptical machine 100 across the floor. Additionally, feet or support pads 134 may be coupled to various portions of the first assembly 102 and may be configured to engage the floor or a supporting surface. The support pads 134 may be adjustable so that the elliptical machine 100 may be leveled on a given surface prior to operation by a user.

The second assembly 104 includes an upright frame member 140 with a control panel 142 coupled therewith. The control panel 142 may include a variety of input devices 144 (e.g., switches, buttons, touch pads) and output devices 146 (e.g., graphic displays, lights, audio speakers) to facilitate control of the elliptical machine 100. The input devices 144 may be used to turn the elliptical machine 100 on or off, to control the amount of resistance being applied to the flywheel of the rear mechanism 112, to enable preset exercise programs, or to otherwise control the operation of the elliptical machine. The various output devices 146 may be used to provide a user with an indication of the operating status of the elliptical machine 100 and to provide other information (e.g., time exercised, calories burned, etc.) to the user.

A variety of additional components may also be coupled with the frame member 140. For example, a tray 148, which may include a cup holder or other structure, may be coupled with the frame member 140. Also, a pair of stationary hand grips 150 may be coupled with the upright frame member 140. While not specifically shown, other components, such as a fan, may also be coupled with the frame member 140 as will be recognized by those of ordinary skill in the art.

The second assembly 104 also includes a first reciprocating arm 152 and second reciprocating arm 154. The first reciprocating arm 152 includes a first end 156 and a second end 158. Similarly, the second reciprocating arm 154 includes a first end 160 and a second end 162. Upper portions of the reciprocating arms 152 and 154 near the first ends 156 and 160 are configured as grips or handles for a user to grasp with their hands while exercising. The second ends 158 and 162 of the reciprocating arms 152 and 154 are pivotally coupled with the first ends 118 and 124 of the foot support members. Each of the reciprocating arms 152 and 154 are pivotally coupled to the frame member 140 through associated pivoting structures 164. The pivoting structures 164 may include, for example, a bearing member that enables the reciprocating arms to pivot back and forth along an axis of rotation 166 in a reciprocating fashion.

During operation of the elliptical machine 100, a user places their feet on the foot pads 122 and 128 and applies a force in order to motivate the foot supports 114 and 116 to move through their defined looping pathways. The pathway of the foot supports 114 and 116 (and thus the foot pads 122 and 128) is defined in part by the connection of the foot supports 114 and 116 with the rear mechanism 112 and in part by the connection of the foot supports 114 and 116 with the reciprocating arms 152 and 154.

In addition to the two assemblies 102 and 104 being connected by way of the pivoting connection of the foot supports 114 and 116 with associated reciprocating arms 152 and 154, the longitudinal frame member 106 is pivotally coupled with the upright frame member 140 by a pivoting structure 170. Again, the pivoting structure 170 may include a bearing component (e.g., a sleeve bearing, a roller bearing, or other appropriate structure) to accommodate pivoting movement of the upright frame member 140 relative to the longitudinal frame member 106. Associated with the pivoting structure 170, a locking or coupling mechanism 172 may be used to affirmatively maintain the frame members 106 and 140 (and, thus, the assemblies 102 and 104) in their operating positions as shown in FIGS. 1 and 2 and as will be described in further detail below.

Figure 3:
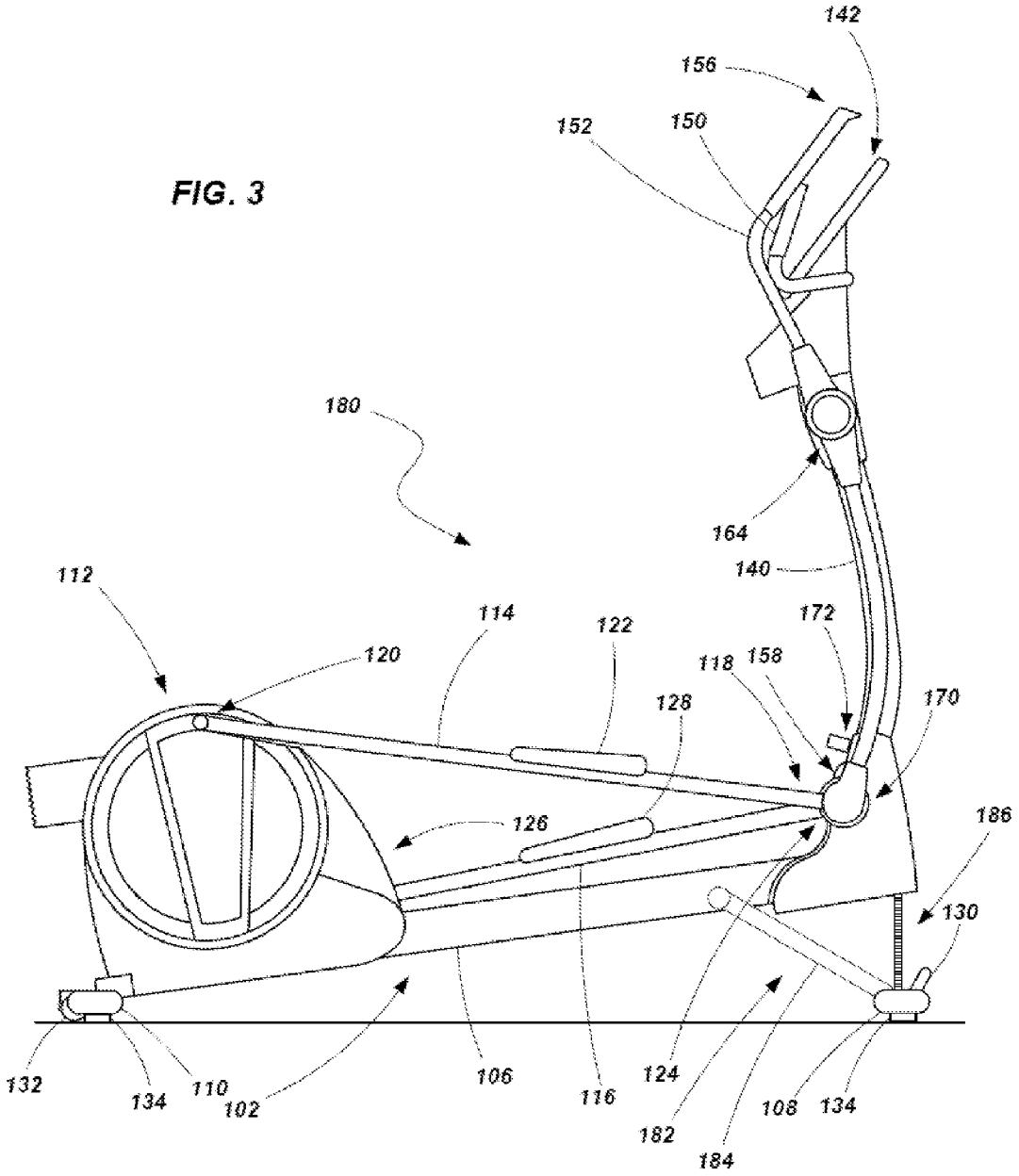
FIG. 3 is side view of an elliptical machine according to another embodiment.

Referring briefly to FIG. 3, another embodiment of an elliptical exercise machine 180 is shown. The elliptical machine is similar to that shown and described with respect to FIGS. 1 and 2 above, including a first assembly 102, a second assembly 104 and the various components described above. The elliptical machine 180 shown in FIG. 3 further includes an incline adjustment mechanism 182 that enables selective height adjustment of the front cross member 108 relative to the rear cross member 110, thereby altering the angular orientation of the foot supports 114 and 116 and their associated pathways. The incline adjustment mechanism 182 may include, for example, a pair of arms 184 or links (one shown in FIG. 3) pivotally coupled between the front cross member 108 and the longitudinal frame member 106, as well as an actuator 186, such as a jackscrew, a pneumatic cylinder, a stepper motor or other appropriate actuating mechanism.

Figure 4:
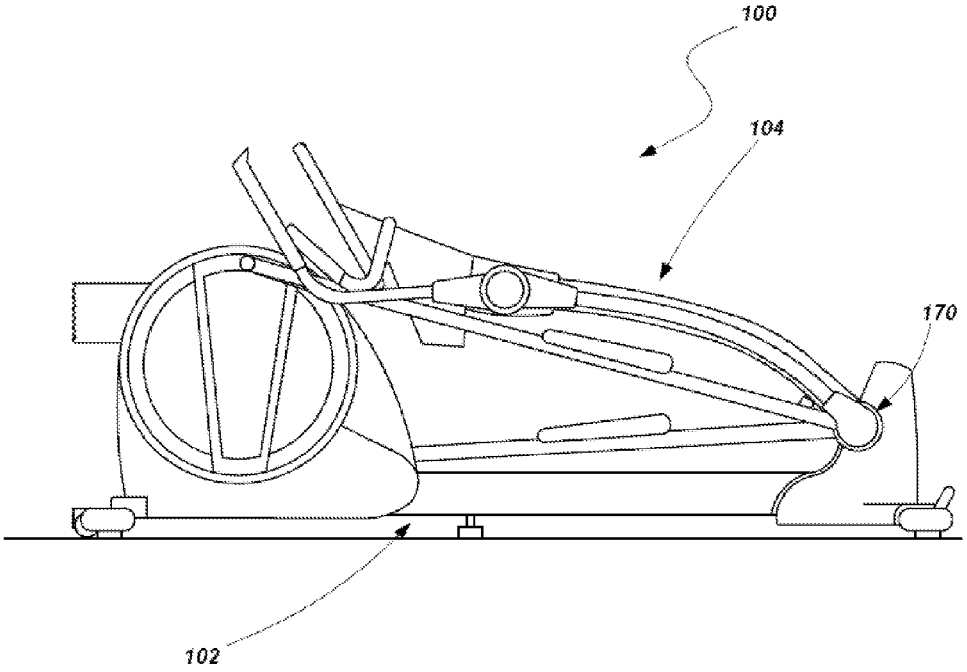
FIG. 4 is a side view of the elliptical machine shown in FIGS. 1 and 2 while in a stowed or stored position.

Referring now to FIG. 4, the elliptical machine 100 is shown in a folded or storage position, wherein the second assembly 104 has been rotated about the pivot structure 170 relative to the first assembly 102 such that the upper portion of the second assembly 104 (e.g., the control panel 142, the hand grips 150) are positioned adjacent the rear portion of the first assembly 102 (e.g., the rear mechanism 112). It is noted that the embodiment described with respect to FIG. 3 is also configured to fold or transition into a collapsed or storage condition in a manner similar to that shown in FIG. 4. In one embodiment, such folding or collapsing of the elliptical machine 180 shown in FIG. 3 may be enabled regardless of the current inclined position of the elliptical machine 180. In another embodiment, the pivoting structure 170 of the elliptical machine 180 may be configured to remain in a locked state until the elliptical machined 180 is in a predefined inclination position (e.g., completely lowered to toward the floor or supporting surface).

Figure 5:
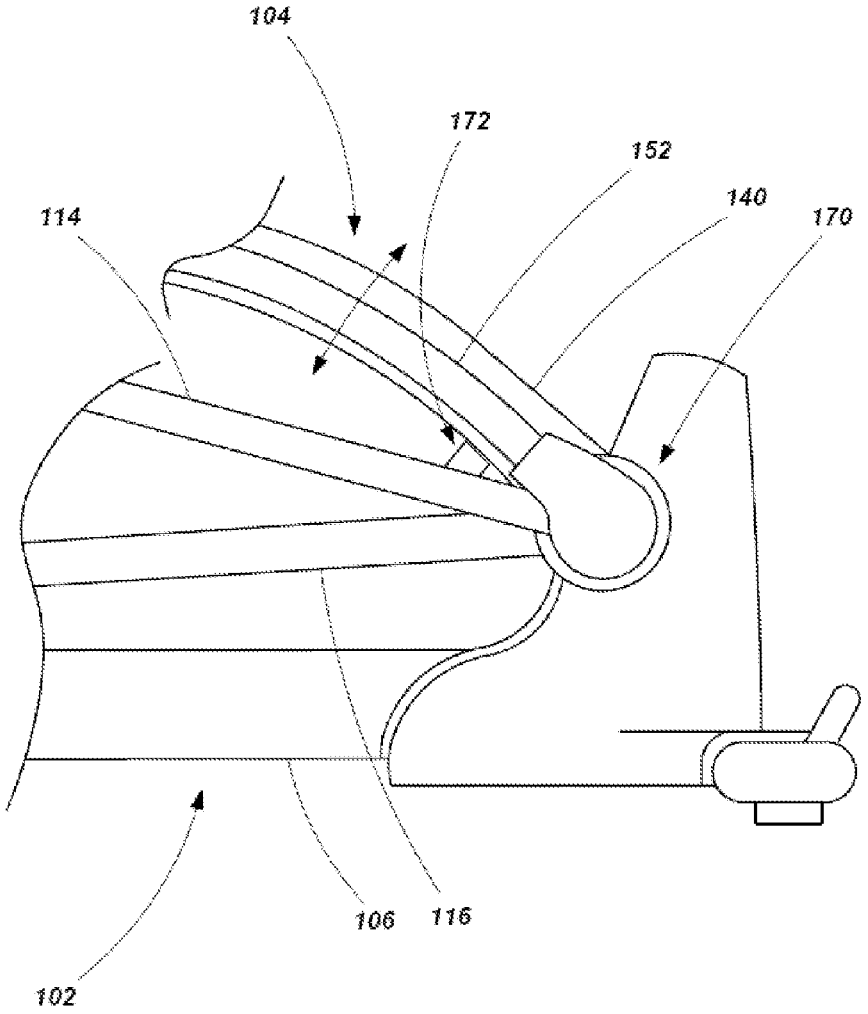
FIG. 5 is an enlarged detail view of certain portions the elliptical machine as shown in FIG. 4.

Referring briefly to FIG. 5, an enlarged view of the various components of the elliptical machine 100 are shown in a folded or collapsed state. FIG. 5 shows the second assembly 104 rotated about the pivot structure 170 relative to the first assembly 102. It is noted that, when in the position or state shown in FIGS. 4 and 5, the pivotal axes of the connections between foot supports 114 and 116 and associated reciprocating arms 152 and 154 are aligned with the pivotal axis of the pivot structure 170 which couples the longitudinal frame member 106 and the upright frame member 140.

Figure 6:
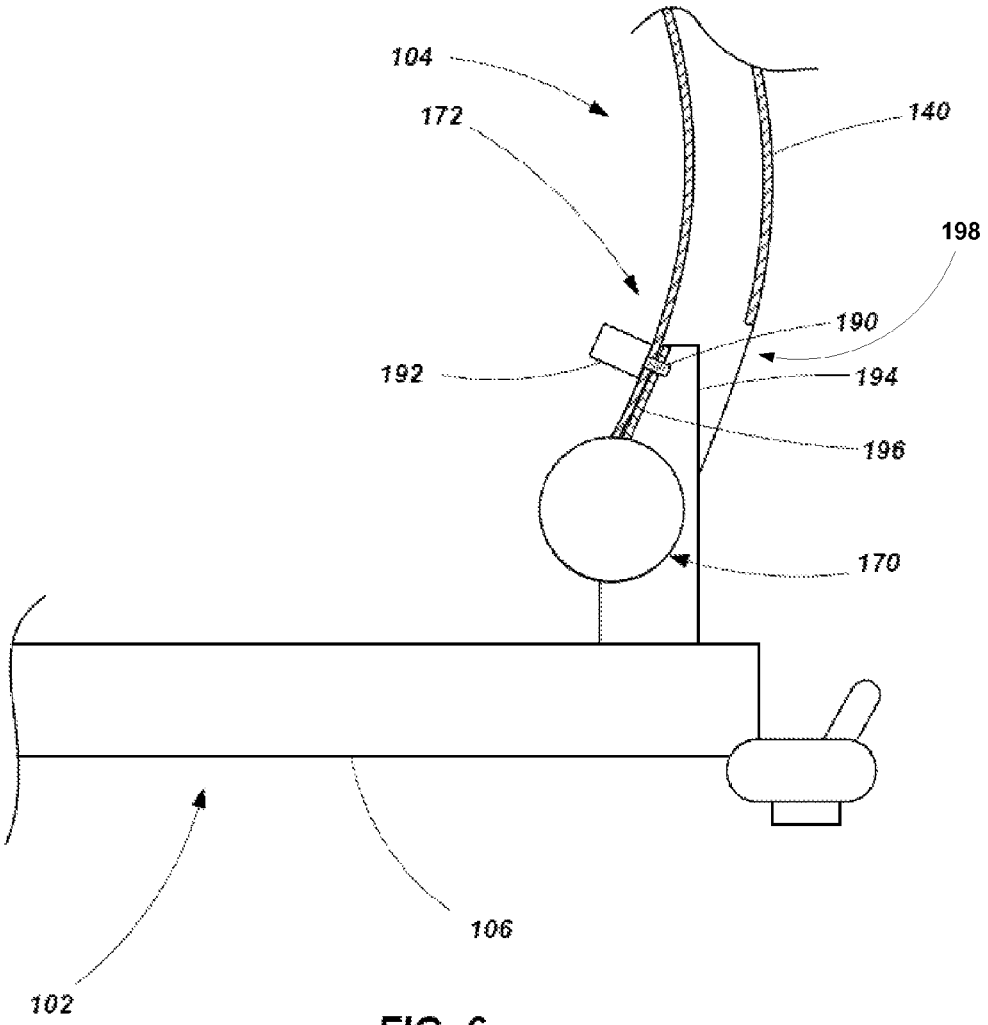
FIG. 6 is a partial cross-sectional view of a portion of the elliptical machine.

Referring to FIG. 6, a partial cross-sectional view is shown of portions of the first and second assemblies 102 and 104 including a locking or coupling mechanism 172 which is engaged to maintain the first and second assemblies 102 and 104 in their operating positions. In one embodiment, the coupling mechanism 172 may include a fastener 190 having a handle or knob 192 coupled therewith enabling a user to rotate the fastener by hand (i.e., without the need for additional tools). The fastener 190 may be configured to be rotationally coupled with the upright frame member 140 of the second assembly 104. The fastener may be configured to threadably engage a structure or component of the first assembly 102. For example, a post 194 or other structural component may be coupled with the longitudinal frame member 106 and include, for example, a plate 196 through which a threaded aperture is formed. The fastener 190 may then selectively engage and disengage the threaded aperture in order to either maintain the first and second assemblies 102 and 104 in an operating condition (as shown in FIGS. 1, 2, 3 and 6) or to enable relative rotation of the first and second assemblies 102 and 104 so that they may be placed in a stored or collapsed condition (as depicted in FIGS. 4 and 5). While the embodiment shown in FIG. 5 includes a fastener 190 used to affirmatively couple the first assembly 102 and the second assembly 104 in an operating position, other mechanisms and structures may also be used. For example, a locking mechanism with a cam surface may be used to provide an affirmative coupling. Other examples may include locking pins that may be inserted in aligned apertures of different components of the first and second assemblies 102 and 104.

It is noted that the upright arm 140 of the second assembly 104 is configured such that it does not interfere with the post 194 or plate 196 (or other similar structure) when rotating between an operational position and a collapsed position. For example, if the upright arm 140 is formed from structural tubing (e.g., with a square or rectangular cross-section), a portion of the tubing may be removed, as shown in FIG. 6, to provide an opening 198 that enables non-interfering rotation of the upright frame member 140 relative to the post 194 and plate 196.

While not specifically shown, a mechanism or structure may be also be provided to lock the first and second assemblies 102 and 104 in a collapsed position so that, for example, if an individual desires to move the elliptical machine 100 (or 180) while it is in the collapsed position, the first and second assemblies 102 and 104 will maintain their positions relative to each other.

INDUSTRIAL APPLICABILITY

Elliptical exercise machines, while popular for residential use, inherently take up a substantial amount of space in a user's home or apartment. For example, in one embodiment, an elliptical machine may be approximately 24 to 30 inches in width, approximately 76 to 84 inches in length and approximately 62 to 70 inches in height. Some users may not desire to permanently dedicate so much space in their residence to an exercise machine. The elliptical machines described herein provide the ability to place the machine in a collapsed position or state when not in use so that the elliptical machine may be stored or more easily maneuvered and transported.

One of the advantages of the described embodiments above is that the elliptical machine is configured in two assemblies, which may be referred to as an upper assembly and a lower assembly, wherein the upper assembly pivots and folds down on to or adjacent to the lower assembly without the need to disassemble or otherwise any of the operational components such as the foot supports or the reciprocating arms. In various prior art devices, in order to collapse or fold into a storage condition. For example, some prior art devices required a "break-away" joint in the foot supports or the reciprocating arms, such that a user would have to disassemble such joints in order to facilitate the folding or collapsing, and then reassemble such joints when the elliptical machine was unfolded or expanded and prior to using the exercise machine again. Moreover, the present design eliminates the possibility of someone trying to use an elliptical machine prior to reassembly of such components, which could possibly result in damage to the machine or injury to the user.

Similarly, folding or collapsing of the assemblies in the elliptical machines described herein does not require the adjustment of any operative components such as the foot supports or reciprocating arms. For example, as previously noted, PCT Patent Application Publication No. WO2008138124 describes a machine wherein the reciprocating arms require adjustment between the operative condition and the stored condition. The present invention does not require any adjustment of the reciprocating arms or the foot supports to in transitioning from the operable condition to the stored condition. Rather, the components of the first assembly all maintain their operational relationship to one another and all the components of the second assembly maintain their operational relationship to one another before and after the folding or unfolding of the elliptical machine. Such a configuration enables very simple folding and deployment of the elliptical machine by a user since they don't have to adjust any critical components (e.g., foot supports or reciprocating arms) and ensures that the elliptical machine is in a ready immediately after unfolding.

The ability to fold or collapse the elliptical machine further provides advantages in moving or transporting the machine when not in use. Besides taking up less space when in a folded state, the elliptical machine is much easier to handle or transport when in the folder state since it is more compact and its center of gravity is more amenable to lifting and maneuvering making it less likely to tip or fall. Furthermore, the ability to fold and unfold the elliptical machine makes it easier to ship or transport in a small package while not requiring assembly after shipping or purchase by the end user.

What is claimed is:

1. An elliptical exercise machine comprising:

a first assembly comprising:

a first frame member;

a rear rotational mechanism associated with the first frame member;

a first foot support member having a first end and a second end, wherein the second end of the first foot support member is pivotally coupled to a portion of the rotational mechanism;

a second foot support member having a first end and a second end, wherein the second end of the second foot support member is pivotally coupled to a second portion of the rotational mechanism;

a second assembly comprising:

a second frame member; a pivot structure coupled between the first frame member and the second frame member;

a first reciprocating arm having a first end and a second end, wherein the second end of the first reciprocating arm is directly and pivotally coupled with the first end of the first foot support and the first reciprocating arm is directly and pivotally coupled to the second frame member;

a second reciprocating arm having a first end and a second end, wherein the second end of the first reciprocating arm is directly and pivotally coupled with the first end of the first foot support and the first reciprocating arm is directly and pivotally coupled to the second frame member;

wherein the second assembly is pivotally displaceable between a first position and a second position relative to the first assembly;

wherein the first frame member, the rotational mechanism, the first foot support member and the second foot support member maintain their operational relationships with each other while in both the first position and the second position; and wherein the second frame member, the first reciprocating arm and the second reciprocating arm maintain their operational relationships with each other while in both the first position and the second position; and wherein the pivotal coupling between the first foot support and the first reciprocating arm defines a first pivotal axis and the pivotal coupling between the second foot support and the second reciprocating arm defines a second pivotal axis;

wherein the pivotal coupling between the first frame member and the second frame member defines a third pivotal axis; and wherein the first pivotal axis, the second pivotal axis and the third pivotal axis remain aligned during displacement of the second assembly between the first and second positions.

2. The elliptical exercise machine of claim 1, wherein the axis of the pivotal coupling between the first foot support and the first reciprocating arm, the axis of the pivotal coupling of the second foot support and the second reciprocating arm, and the axis of the pivotal structure are substantially aligned when the second assembly is in the second position.

3. The elliptical exercise machine of claim 1, wherein the pivotal coupling between the first foot support and the first reciprocating arm and the pivotal coupling second foot support and the second reciprocating arm remain in place during displacement of the second assembly between the first and second positions.

4. The elliptical exercise machine of claim 1, further comprising a locking mechanism configured to selectively maintain the second assembly in the first position relative to the first assembly.

5. The elliptical exercise machine of claim 1, wherein the locking mechanism includes a fastener coupled with a hand-rotatable handle, the fastener being associated with the second assembly, wherein the fastener is configured to selectively engage a component associated with the first assembly.

6. The elliptical exercise machine of claim 1, further comprising:

a first cross member coupled with the first frame member;

a second cross member coupled with the first frame member;

a handle coupled with the first cross member; and at least one wheel coupled with the second cross member.

7. The elliptical exercise machine of claim 1, further comprising:

a locking mechanism configured to selectively maintain the second assembly in the first position relative to the first assembly; and a second mechanism configured to selectively maintain the second assembly in the second position relative to the first assembly.

8. An elliptical machine comprising:

a first assembly comprising:

a first frame member;

a rear rotational mechanism associated with the first frame member;

a first foot support member pivotally coupled to a portion of the rotational mechanism;

a second foot support member pivotally coupled to another portion of the rotational mechanism;

a second assembly comprising:

a second frame member pivotally coupled with the first frame member;

a first reciprocating arm directly and pivotally coupled with the second frame member at a first location on the first reciprocating arm and directly and pivotally coupled to the first foot support at a second location on the first reciprocating arm;

a second reciprocating arm directly and pivotally coupled with the second frame member at a first location on the second reciprocating arm and directly and pivotally coupled with the second foot support at a second location on the second reciprocating arm;

wherein the second assembly is pivotally displaceable relative to the first assembly between an operating position and a storage position;

wherein the first reciprocating arm and the second reciprocating arm are not adjusted relative to the second frame member in order to place the second assembly in the storage position; and wherein the first foot support and the second foot support are not disconnected from the rotational mechanism in order to place the second assembly in the storage position; and wherein the pivotal coupling between the first foot support and the first reciprocating arm defines a first pivotal axis and the pivotal coupling between the second foot support and the second reciprocating arm defines a second pivotal axis;

wherein the pivotal coupling between the first frame member and the second frame member defines a third pivotal axis; and wherein the first pivotal axis, the second pivotal axis and the third pivotal axis remain aligned during displacement of the second assembly between the first and second positions.

9. The elliptical exercise machine of claim 8, further comprising a locking mechanism configured to selectively maintain the second assembly in the operating position.

10. The elliptical exercise machine of claim 9, wherein the locking mechanism includes a fastener coupled with a hand-rotatable handle, the fastener being associated with the second assembly, wherein the fastener is configured to selectively engage a component associated with the first assembly.

11. The elliptical exercise machine of claim 8, wherein the pivotal coupling between the first foot support and the first reciprocating arm and the pivotal coupling second foot support and the second reciprocating arm remain in place during displacement of the second assembly between the operating and storage positions.

12. The elliptical exercise machine of claim 8, further comprising:

a first cross member coupled with the first frame member;

a second cross member coupled with the first frame member;

a handle coupled with the first cross member; and at least one wheel coupled with the second cross member.

13. The elliptical exercise machine of claim 8, wherein the axis of the pivotal coupling between the first foot support and the first reciprocating arm, the axis of the pivotal coupled of the second foot support and the second reciprocating arm and the axis of the pivotal coupling of the first frame member and the second frame member are substantially aligned when the second assembly is in the storage position.

14. The elliptical exercise machine of claim 8, further comprising:

a locking mechanism is configured to selectively maintain the second assembly in the first position relative to the first assembly; and a second mechanism configured to selectively maintain the second assembly in the second position relative to the first assembly.

15. A method of storing an elliptical exercise machine, the method comprising:

providing a first assembly having a frame member, a rear rotational mechanism, a first foot support having a first end and a second end and a second foot support having a first end and a second end;

providing a second assembly having a second frame member, a pivot structure coupled with the first assembly and the second assembly, and wherein displacing the first assembly from an operating position to a stored position includes pivoting about the pivot structure, a first reciprocating arm having a first end and a second end and a second reciprocating arm having a first end and a second end, wherein the second end of the first reciprocating arm is directly and pivotally coupled with the first end of the first foot support and wherein the second end of the second reciprocating arm is directly and pivotally couple with the first end of the second foot support;

displacing the first assembly from the operating position to the stored position while maintaining the operational relationships of the first frame member, rotational mechanism, the first foot support and the second foot support and while maintaining the operational relationships of the first reciprocating arm, the second reciprocating arm and the second frame member; and wherein the pivotal coupling between the first foot support and the first reciprocating arm defines a first pivotal axis and the pivotal coupling between the second foot support and the second reciprocating arm defines a second pivotal axis;

wherein the pivotal coupling between the first frame member and the second frame member defines a third pivotal axis; and wherein the first pivotal axis, the second pivotal axis and the third pivotal axis remain aligned during displacement of the second assembly between the first and second positions.

16. The method according to claim 15, further comprising:

directly and pivotally coupling the first foot support with the first reciprocating arm;

directly and pivotally coupling the second foot support with the second reciprocating arm; and maintaining the direct and pivotal coupling between the first foot support with the first reciprocating arm and maintaining the direct and pivotal coupling between the second foot support with the second reciprocating arm while displacing the first assembly from the operating position to the stored position.

17. The method according to claim 15, further comprising disengaging a locking mechanism prior to displacing the first assembly from the operating position to the stored position.

18. The method of claim 15, further comprising:

locking the first assembly and the second assembly in the stored position.

* * * * *